US005317977A

United States Patent [19]

Omessi

[11] Patent Number: 5,317,977

[45] Date of Patent: Jun. 7, 1994

[54] ADJUSTABLE TABLE EXTENSION

[76] Inventor: Benjamin Omessi, 900 Lake Shore Dr., Suite 2701, Chicago, Ill. 60611

[21] Appl. No.: 727,609

[22] Filed: Jul. 9, 1991

[51] Int. Cl.[5] ..... A47B 57/00

[52] U.S. Cl. ..... 108/97; 108/108

[58] Field of Search ..... 108/108, 152, 107, 98, 108/70, 97; 211/86, 187; 248/214, 223.3, 275.2, 243

[56] References Cited

U.S. PATENT DOCUMENTS

| | | | |
|---|---|---|---|
| 1,108,692 | 8/1914 | Burd | 108/97 |
| 1,426,787 | 8/1922 | Spencer | 248/214 X |
| 1,878,864 | 9/1932 | Lane et al. | 108/97 X |
| 2,090,176 | 8/1937 | Besancon | 108/97 X |
| 2,558,323 | 6/1951 | Strun | 108/97 X |
| 2,633,996 | 4/1953 | Litchfield | 108/97 X |
| 2,709,563 | 5/1955 | Starkey . | |
| 2,771,332 | 11/1956 | McGinley . | |
| 3,289,615 | 12/1966 | Marschak | 108/97 |
| 3,301,406 | 1/1967 | Scott | 108/97 |
| 3,631,821 | 1/1972 | Zachariou . | |
| 3,741,131 | 6/1973 | Leadbetter | 108/97 |
| 3,965,826 | 6/1976 | Markham . | |
| 4,022,136 | 5/1977 | Schott . | |
| 4,099,470 | 7/1978 | Cannon, Jr. . | |
| 4,142,638 | 3/1979 | Vargo | 248/243 X |
| 4,311,101 | 1/1982 | de Almagro | 108/108 X |
| 4,606,280 | 8/1986 | Poulton et al. . | |
| 5,104,080 | 4/1992 | Berger | 108/152 X |

*Primary Examiner*—Jose V. Chen

*Attorney, Agent, or Firm*—Fitch, Even, Tabin & Flannery

[57] ABSTRACT

An adjustable table extension includes a clamp member of sheet metal formed to compressedly engage a table top The clamp member includes a plurality of outwardly directed barbs or projections. A hanger member includes a vertical wall with slots for engaging the barbs, and a horizontal table surface A plurality of slots are formed to provide vertical adjustment of the hanger member.

11 Claims, 3 Drawing Sheets

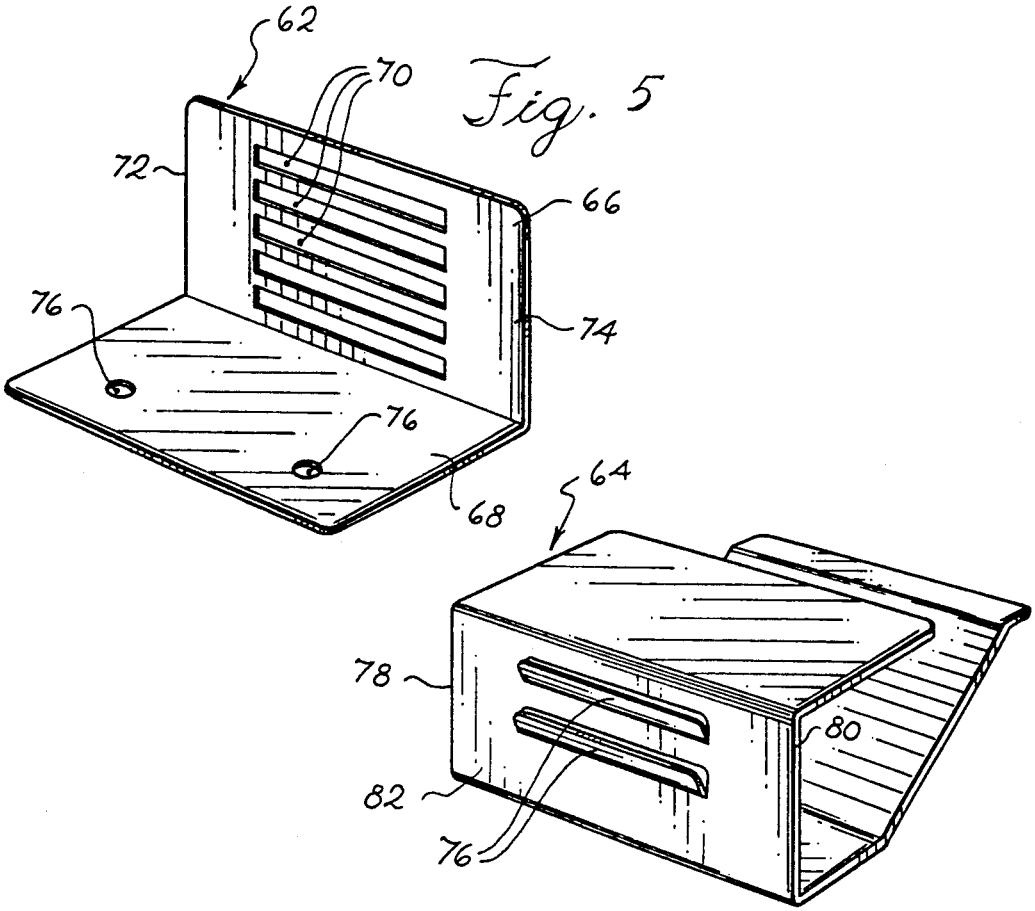
Fig. 5
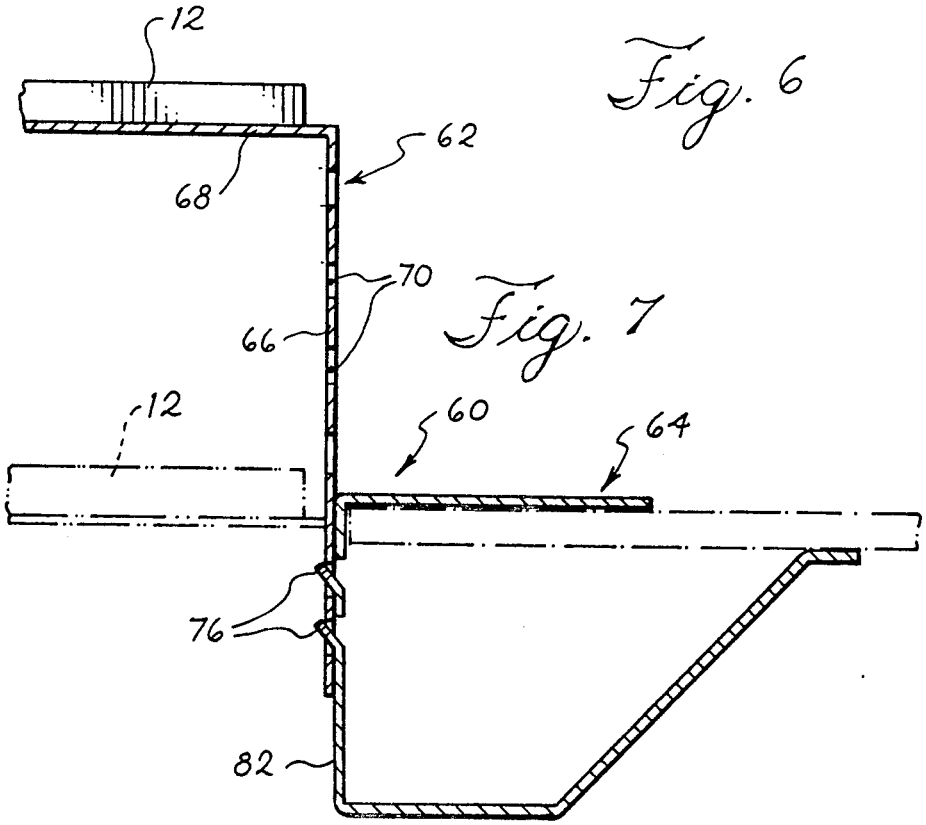
Fig. 6
Fig. 7

ADJUSTABLE TABLE EXTENSION

BACKGROUND OF THE INVENTION

1. Field of the Invention

The present invention is directed to extensions for existing tables, and in particular removable table extensions which are adjustable in height.

2. Description of the Related Art

Various arrangements have been proposed for extending a table top surface in a way which would accommodate people needing special considerations, such as physically handicapped persons who are confined to wheelchairs. Even if clearance is provided underneath a conventional table for the legs of a wheelchair patient, most wheelchairs have fixed arms which will not pass underneath a table, and accordingly, prevent a person in the wheelchair from assuming a conventional position at a dining table, with the mid-portion of the person's body positioned immediately adjacent an edge of the table. Despite the proposals for table attachments over the years, there is still a need to provide a table extension for persons confined to wheelchairs and others who cannot be positioned immediately adjacent a table edge, which is easily mated to a wide variety of existing table structures without requiring modification to the table, and which is adjustable to accommodate persons seated at different heights.

U.S. Pat. No. 4,022,136 provides a pair of opposed desks for persons confined to wheelchairs. The desks are mounted to brackets resembling shelf standards, being suspended from a vertical panel carried on a wheeled cart. The desks are free-standing, and includes a pair of opposed desk surfaces to accommodate persons confined to wheelchairs, facing each other U.S. Pat. No. 4,099,470 discloses an attachment to card tables, having a tongue portion inserted between the table top and underlying frame portion of a card table The attachments are located at corners of the card table, and are of a size to accommodate a drinking glass, for example.

U.S. Pat. No. 2,771,332 discloses a serving tray for automobiles having a hook portion received in a door of an automobile, and a pair of adjustable legs which engage the interior panel of the automobile door, to adjust the table at a horizontal position.

U.S. Pat. Nos. 3,301,406 and 4,311,101 disclose attachments for mating with a table leg. U.S. Pat. No. 3,301,406 discloses a spring wire having an upper portion for engaging a table top surface, and a pair of underlying finger portions which straddle the table leg and engage the underneath surface of the table top to hold the spring wire in position. A flat table member is coupled to the spring wire to receive cantilever support at a table corner. U.S. Pat. No. 4,311,101 is hooked onto a table leg at a table corner.

A number of patents have been directed to a screw-type clamping to a table. A certain amount of careful attention must be paid in aligning and testing the clamping to make sure the clamps are securely fastened to a table. Included are U.S. Pat. Nos. 1,108,692; 2,558,323; 2,709,563; and 3,289,615.

It is known provide shelf arrangements where slotted hangers receive members having barbed projections to be received in the hanger slots. Included are U.S. Pat. Nos. 3,631,821 and 3,965,826.

U.S. Pat. No. 4,606,280 discloses a special shelf extender to be received in a slotted edge of a shelf used to display merchandise in a store. The shelf extender is made of molded plastic, and includes a pair of opposed walls, with edges for engaging the shelf channel.

As has been mentioned above, the need still exists for a table extension which is easily installed without modification to a table, by untrained personnel, such as personnel employed in the foodservice and patient care industries.

SUMMARY OF THE INVENTION

The present invention provides an improved table extension which is easy to mount to a wide variety of existing tables, and which is adjustable to accommodate individuals of different sizes. The use of such table extensions will greatly improve the social opportunities for persons confined to wheelchairs, who can be seated with ambulatory persons at meals and other social engagements.

The above stated objects and other objects of the present invention, which will be seen from the appended description and drawings are provided in an adjustable table extension, comprising:

a clamp member including a body with a pair of generally opposed engaging portions for engaging the upper and lower opposed surfaces of a table top, and an intermediate bight portion having retention means including at least one outwardly and upwardly inclined projection; and a hanger member including an L-shaped body with a generally upright mounting wall and a generally horizontal portion including a table means, the mounting wall including internal edge means defining an aperture, with the edge means interlocking with said projection when said projection is received in said aperture.

BRIEF DESCRIPTION OF THE DRAWINGS

FIG. 5 is a perspective view of an alternative embodiment of a hanger member;

FIG. 6 is a perspective view of an alternative embodiment of a clamping member;

FIG. 7 is a cross-sectional, elevational view showing the hanger member installed in an optional configuration.

DETAILED DESCRIPTION OF THE PREFERRED EMBODIMENTS

Figure 1:
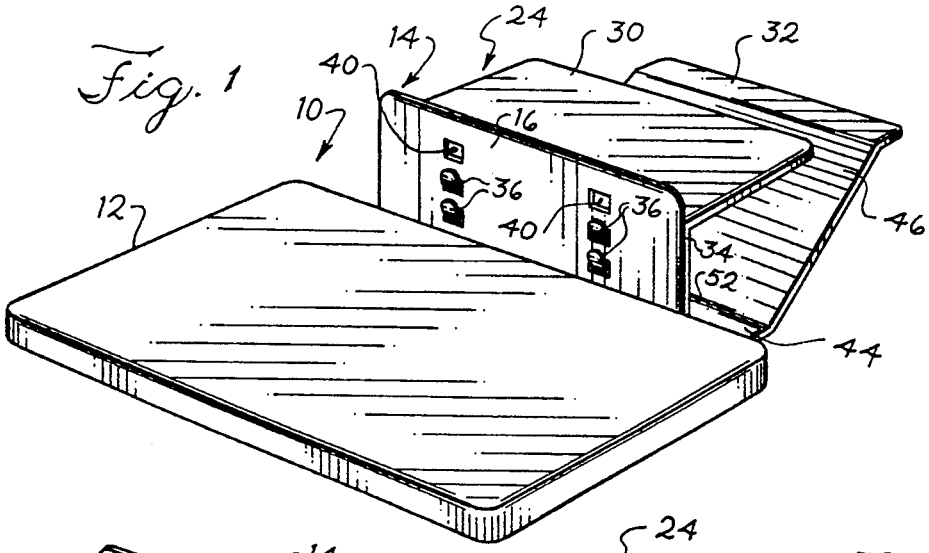
FIG. 1 is a perspective view of an adjustable table apparatus ac to principles of the present invention.

Referring now to the drawings, and initially to FIGS. 1–4, a first embodiment of an adjustable table extension apparatus according to principles of the present invention is generally indicated at 10. Apparatus 10, in the preferred embodiment, is formed from three separate pieces, two of which are preferably made from folded sheet metal, illustrated in FIGS. 2 and 3, and a tray table 12 of conventional construction, as may be from sheet metal, wood, or laminated particle board, for example.

Figure 2:
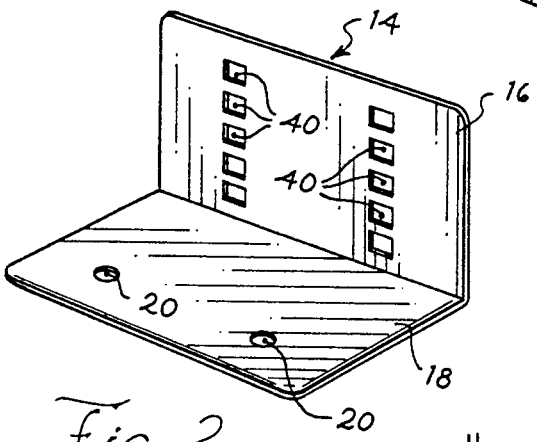
FIG. 2 is a perspective view of a hanger portion thereof.

Referring now to FIG. 2, a hanger member 14 includes a slotted vertical portion 16 and a horizontal portion 18. In the preferred embodiment, the horizontal portion 18 includes apertures 20 for receiving screw fasteners to secure the tray table 12 to the hanger. However, it will be appreciated that the tray table 12 can be omitted if desired, with the horizontal portion 18 serving as a tray table. If desired, the horizontal portion 18 of the hanger can be enlarged, and formed with a stamping operation to provide desired details as are customary in pressed metal trays, such as a peripheral upstanding border or lip which could be dimensioned to receive a standardized cafeteria tray, for example.

Figure 3:
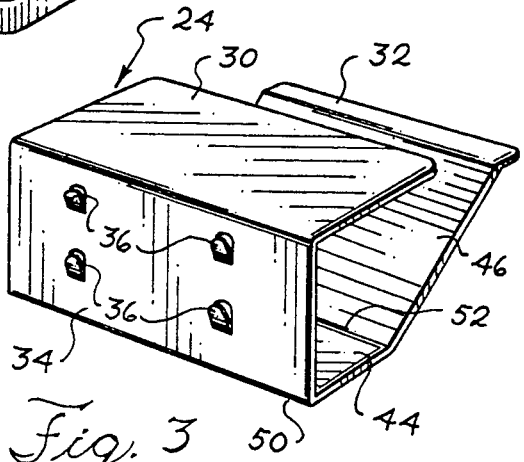
FIG. 3 is a perspective view of a clamping member thereof.
Figure 4:
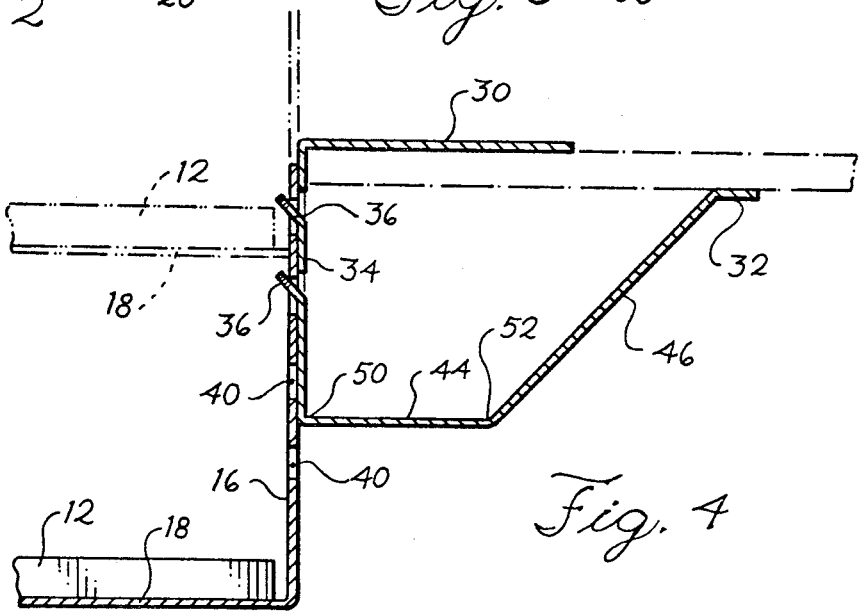
FIG. 4 is a cross-sectional, elevational view of the apparatus of FIG. 1.

Referring to FIG. 3, a clamping member is generally indicated at 24. The clamp member 24 includes a pair of opposed engaging portions or ends 30, 32 which are preferably oriented in a horizontal direction, and which are arranged generally one above the other and preferably laterally offset from one another so as to engage the upper and lower opposed surfaces of a table top, as illustrated in FIG. 4, in phantom. The clamping member further includes an intermediate bight portion 34 having a plurality of retention means or outwardly and upwardly directed projections 36. Preferably, the projections 36 are spaced laterally apart from one another, and in the preferred embodiment are arranged in a pair of laterally spaced series of projections aligned in generally vertical directions. If desired, the upper or lower projections of each series could be omitted Referring again to FIG. 2, the vertical portion of hanger 14 is slotted by two spaced apart series of slots. In the preferred embodiment, the series of slots are generally aligned in vertical directions. The slots are indicated at 40, and are dimensioned so as to at least partly receive the free ends of projections 36, in the manner indicated in FIG. 1. In the preferred embodiment, the number of slots in each series of slots is larger than the number of projections in each series of projections. In the embodiment illustrated in FIGS. 1–4, each of the series of projections has two projections, one above the other, while each series of apertures in the hanger 14 has five apertures. Thus, a user is able to select a particular pair of apertures to receive the projections 36, thus providing a range of adjustments illustrated in FIG. 4. For example, when the projections 36 are received in the uppermost slots 40, the tray table is adjusted at a lower position indicated in FIG. 4 in solid lines However, if the projections are received in the lower most slots 40, the tray table will be aligned at an elevated position, indicated in phantom in FIG. 4.

Referring to FIGS. 3 and 4, the clamping member 24 of the preferred embodiment further includes a fourth generally horizontal portion and an upwardly inclined portion 46 extending toward the table interior. The clamping member 24 is preferably formed of material which will provide a resilience when the ends 30, 32 are wedged apart from one another by a table top. In the preferred embodiment, the clamping member 24 is formed of a stainless steel composition, which imparts a bias force to the lower end 32 as portions 44, 46 are deflected away from the upper end 30. Thus, the lower free end 32 receives spring-loaded cantilever support from the upper end 30 and bight portion 34 when fitted to a table top in the manner indicated in FIG. 4.

Figure 8:
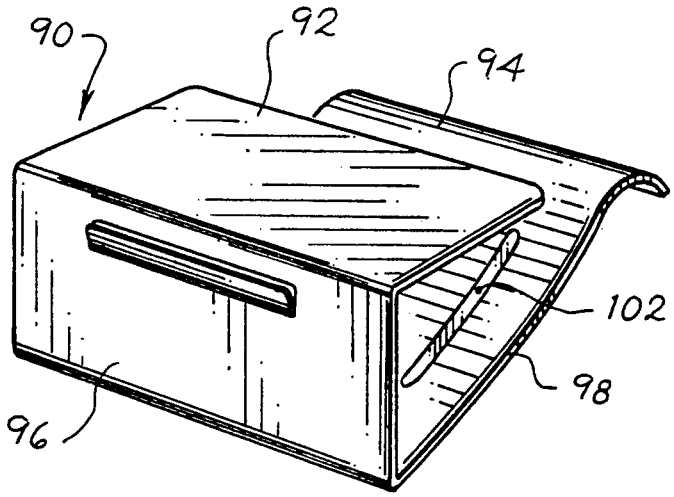
FIG. 8 is a perspective view of a further alternative embodiment of a clamping member.
Figure 9:
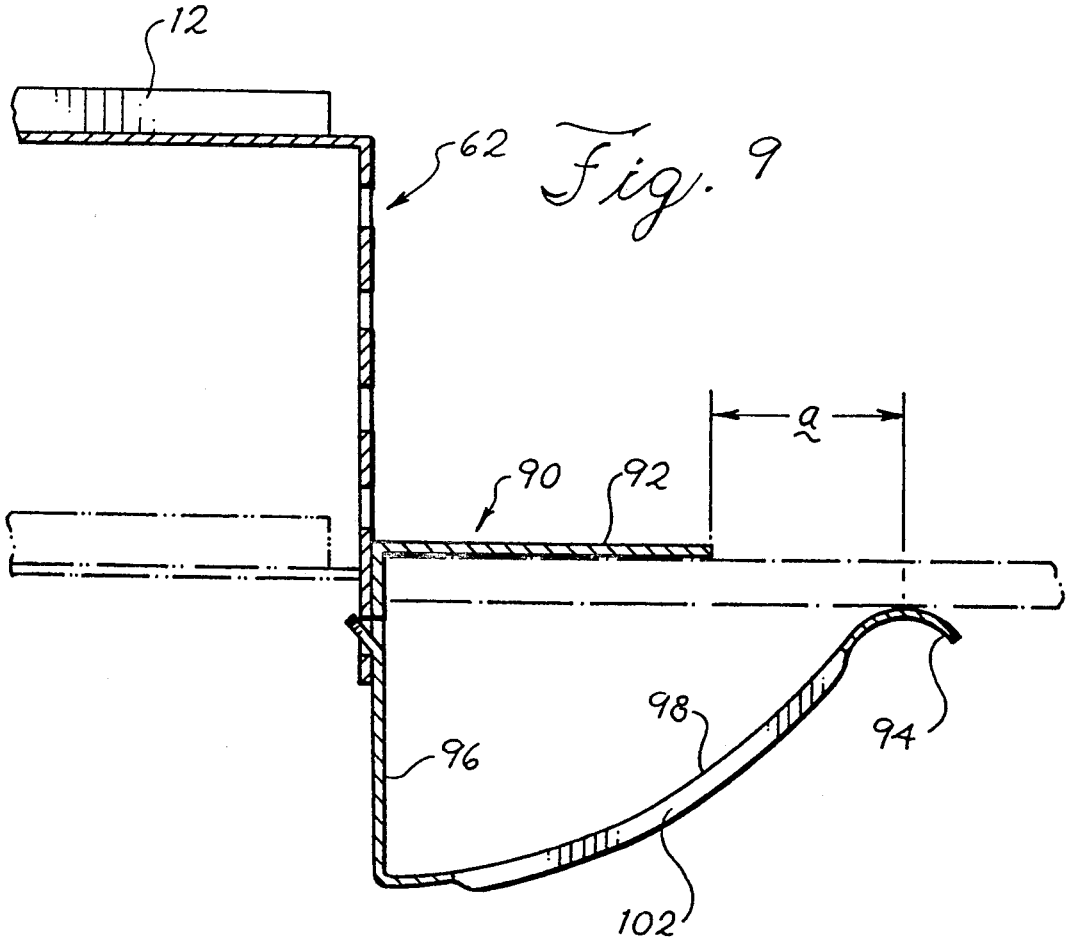
FIG. 9 is a cross-sectional, elevational view of a further embodiment.

In the preferred embodiment, the clamping member 24 is preferably formed by folding a generally rectangular strip of sheet metal material, and consequently, each of the portions 30–34 and 44–46 are of equal width Other configurations are, of course, possible. For example, if greater deflection of the lower clamping end 32 is desired, the horizontal and angled portions 44–46 can be slotted adjacent the fold lines 50 and/or 52 to decrease the bending resistance of the clamping member. As a further alternative, the clamping concave member portions 44–46 can be replaced by a single, continuously curved concave portion when viewed from above, and the free end 32 can comprise a reversely bent curved portion, generally concave when viewed from above as illustrated in FIGS. 8 and 9.

The protrusions 36 of the preferred embodiment have generally rounded upper ends, although they could have sharper, generally pointed or triangular upper free end portions. In any event, it is generally preferred that the protrusions be upwardly and outwardly directed with respect to the table top.

The spacing of the apertures 40 in a vertical direction provides the height adjustment as explained above, and the spacing of the apertures in a lateral or horizontal direction has been found to provide a surprising stability when combined with the clamping member according to principles of the present invention.

Turning now to FIGS. 5–7, an alternative embodiment of an adjustable table apparatus is generally indicated at 60 (see FIG. 7). Apparatus 60 includes a hanger member 62 illustrated in FIG. 5 and a clamping member 64 illustrated in FIG. 6. The hanger member 62 is similar to the hanger member 14 illustrated in FIG. 2, in that it has vertical and horizontal portions 66, 68 and is preferably formed by folding a sheet metal blank at a generally right angle Elongated slots 70 are formed in the vertical portion 66, and are elongated in a generally horizontal direction so as to add end portions adjacent the lateral edges 72, 74 of the vertical portion. The slots 70 are preferably continuous and form a single vertical column or series, as distinguished from the double series or vertical columns illustrated in FIG. 2. Apertures 76 are provided to mount a tray table such as the tray table 12 illustrated in FIG. 1.

FIG. 7 illustrates an alternative method of mounting the tray table to hanger member 62. According to one aspect of the present invention, the hanger members either 14 or 62 can be inverted with the tray table 12 mounted to either opposing surface of the horizontal portions 18 or 68. For example, as illustrated in FIG. 7, the hanger member 62 is shown in an inverted position such that the horizontal portion 68 is located above the vertical portion 66. Although the tray table 12 is illustrated as lying against either one major surface of the horizontal portion 68 or another, it is also possible to form a pocket or hidden recess in the tray table for receiving both major surfaces of the horizontal portion so that the completed tray table and hanger assembly can be installed upright as shown in FIG. 4 or in an inverted position as illustrated in FIG. 7, and still present a continuous support surface to a user.

Referring to FIG. 6, clamping member 64 is substantially identical to the clamping member 24 illustrated in FIG. 3, except that the protrusions 76 are elongated in a generally horizontal direction, and are generally coextensive with the slots 70 of the hanger member. The ends of the upward and outward projections 76 are accordingly located adjacent the lateral sides 78, 80 of the vertically oriented bight portion 82.

Turning now to FIGS. 8 and 9, a further alternative embodiment of a clamping member is generally indicated at 90. The clamping member 90 has opposed end portions 92, 94 joined together through a bight portion 96 and a concave lower portion 98. The end portion 94 is located below end portion 92 and extends there beyond so as to form a lateral offset a, as is shown in the preceding preferred embodiments of the present invention. However, if desired, the offset a can be reduced or eliminated if desired As a further difference over the preceding embodiments, the lower free end 94 has a convex curved configuration when viewed from above but could have a flat, generally horizontal extending configuration as with the end portion 32, described above and illustrated in FIGS. 1, 3 and 4. As in other preferred embodiments of the present invention, the clamping member has a generally concave lower portion but, with the clamping member 90, the lower portion 98 is formed as a single, continuous curved surface as opposed to the angularly displaced portions 44, 46 illustrated in FIG. 4, for example If stiffening of the lower cantilevered portions 98, 94 of the clamping member 90 is desired, reinforcing ribs such as the rib 102 illustrated in FIG. 8 can be pressed or otherwise formed in portion 98. As with the other embodiments described herein, it is generally preferred that the clamping member be formed from sheet metal material, such as stainless steel. However, the clamping member 90 can also be made of molded plastic, as can the other various components of adjustable table apparatus according to principles of the present invention.

The drawings and the foregoing descriptions are not intended to represent the only forms of the invention in regard to the details of its construction and manner of operation Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

I claim:

1. An adjustable table extension, comprising:

a clamp member including a body with a pair of generally opposed engaging portions for engaging the upper and lower opposed surface of a table top, comprising upper and lower free end portions, respectively, coupled together by an intermediate bight portion comprising a series of a first, a second and a third part, with retention means carried on the first part, said retention means including at least one outwardly and upwardly inclined projection with the lower free end extending beyond the upper free end, said second part of said bight portion defining a biasing means extending along an incline, below said upper and said lower free end portions and said third part of said bight portion extending upwardly from said second part toward the lower free end portion, and a hanger member including an L-shaped body with a generally upright mounting wall and a generally horizontal portion including a table means, the mounting wall including internal edge means defining an aperture, with the edge means interlocking with said projection when said projection is received in said aperture.

2. The apparatus of claim 1 further comprising a table member secured to said horizontal body portion to define said table means.

3. The apparatus of claim 1 wherein said clamp member comprises an integral one-piece body with said engaging means comprising generally flat, horizontally extending end portions of said body.

4. The apparatus of claim 3 wherein one said end portion is disposed below and horizontally offset from the other end portion.

5. The apparatus of claim 1 wherein said intermediate bight portion has at least two spaced retention means, each including a plurality of spaced outward projections, and said hanger member vertical wall includes a plurality of edge means defining at least two spaced apart series of apertures, with apertures of the series spaced apart by portions of said vertical wall which interlock with ones of said projections received in said apertures.

6. The apparatus of claim 5 wherein said series of apertures extend in generally vertical direction sand said projections comprise finger members upwardly and outwardly extending from said first wall.

7. The apparatus of claim 5 wherein said series of apertures comprise a sequence of evenly spaced, similarly sized apertures separated by a strip portions portion to define said table means.

8. The apparatus of claim 5 further comprising a table member secured to said horizontal body portion to define said table means.

9. An adjustable table extension, comprising:

a clamp member including a body with a pair of generally opposed engaging portions for engaging the upper and lower opposed surfaces of a table top, comprising upper and lower free end portions, respectively, coupled together by an intermediate bight portion comprising a series of a first, a second and a third part, with at least two spaced retention means carried on the first part, said retention means each including a plurality of spaced outward projections, said second part of said bight portion defining a biasing means and extending along an incline below said upper and said lower free end portions and said third part of said bight portion extending from the second part, upwardly toward the lower free end portion; and a hanger member including an L-shaped body with a horizontal portion including a table means and a generally upright mounting wall including a plurality of edge means defining at least two spaced apart series of apertures, with apertures of the series spaced apart by portions of said mounting wall which interlock with ones of said projections received in said apertures.

10. The apparatus of claim 9 wherein said series of apertures extend in generally vertical directions and comprise a sequence of evenly spaced, similarly sized apertures separated by a strip portions of said mounting wall, and wherein said projections comprise finger members upwardly and outwardly extending from said first wall.

11. The apparatus of claim 10 further comprising a table member secured to said horizontal body portion to define said table means.

* * * * *